US008156610B2

(12) United States Patent
McKenzie et al.

(10) Patent No.: US 8,156,610 B2
(45) Date of Patent: Apr. 17, 2012

(54) WRITING ASSIST DEVICE

(75) Inventors: Kara McKenzie, Albany, CA (US); Craig Miller, Lake Stevens, WA (US); Stacey Mosley, Levittown, PA (US); Jonathan Saathoff, McHenry, IL (US)

(73) Assignee: Northwestern University, Evanston, IL (US)

( * ) Notice: Subject to any disclaimer, the term of this patent is extended or adjusted under 35 U.S.C. 154(b) by 174 days.

(21) Appl. No.: 12/072,491

(22) Filed: Feb. 26, 2008

(65) Prior Publication Data

US 2008/0217507 A1 Sep. 11, 2008

Related U.S. Application Data

(60) Provisional application No. 60/903,974, filed on Feb. 28, 2007.

(51) Int. Cl.
*A46B 13/00* (2006.01)

(52) U.S. Cl. ..... 15/443; 248/118.5; 401/6

(58) Field of Classification Search ..... 248/118, 248/118.5, 118.1; 15/443, 437; D19/81, D19/84, 85; 401/6, 7, 8, 48
See application file for complete search history.

(56) References Cited

U.S. PATENT DOCUMENTS

| | | | | |
|---|---|---|---|---|
| 78,655 | A | 6/1868 | Eastman | |
| 1,438,114 | A * | 12/1922 | Hume | 401/6 |
| 2,497,418 | A * | 2/1950 | Schroeder, Jr. | 401/48 |
| 3,972,628 | A * | 8/1976 | Stevers | 401/48 |
| 4,917,517 | A * | 4/1990 | Ertz | 401/6 |
| D309,157 | S * | 7/1990 | Ertz | D19/55 |
| 5,037,224 | A * | 8/1991 | Wright | 401/48 |
| 5,143,463 | A | 9/1992 | Pozil et al. | 401/6 |
| 5,626,430 | A | 5/1997 | Bistrack | 401/6 |
| 6,238,358 | B1 | 5/2001 | Philot et al. | 602/5 |
| 6,854,913 | B2 * | 2/2005 | Farrell et al. | 401/195 |
| 2005/0263652 | A1 | 12/2005 | Stair | 248/118.5 |

OTHER PUBLICATIONS

Society for the Physically Disabled, Specialised Assistive Technology Centre—WritingTools, http://www.spd.org/programmes/atc_writingtools.html, Feb. 5, 2007.

Nihal Tas, MD, Gülcin Kaymak Karatas, MD, and Vesile Sepici, MD, Hand Orthosis as a Writing Aid in Writer's Cramp, Movement Disorders, vol. 16, No. 6, 2001, pp. 1185-1188.

Mahmut Edip Gürol, MD, Mustafa Ertas, MD, Hasmet Ayhan Hanagasi,MD, Hüseyin Alparslan Sahin, MD, Gancay Gürsoy, MD, and Murat Emre,MD, Stiff Leg Syndrome: Case Report, Movement Disorders, vol. 16, No. 6, 2001, pp. 1189-1193.

* cited by examiner

*Primary Examiner* — A. Joseph Wujciak, III

(57) ABSTRACT

A writing assist device includes a hand-receiving body having an exterior surface with a convex contour for ergonomically receiving the palm and/or fingers of the hand of a user from underneath and a base adapted to easily move by pushing or pulling on a writing surface to allow writing by the user. The body includes an inclined channel for receiving a writing instrument, such as a pen or pencil, and a securing element to releasably secure the writing instrument at an inclined angle in the channel. The channel is disposed on the body such that the thumb and index finger of the user lie on opposite sides of the channel during writing in manner that generally resembles the natural gripping of a pen or pencil between the thumb and index finger of an able-bodied person to impart a more natural feeling of writing control. A removable, stretchable cover can be placed on the exterior surface of the body for the comfort of the user before the user places his/her hand on the device.

12 Claims, 4 Drawing Sheets

WRITING ASSIST DEVICE

This application claims benefits and priority of provisional application Ser. No. 60/903,974 filed Feb. 28, 2007, the disclosure of which is incorporated herein by reference.

FIELD OF THE INVENTION

The present invention relates to a writing assist device to help individuals with limited use of their hands and/or wrists to write using a conventional pen or pencil.

BACKGROUND OF THE INVENTION

Some individuals, due to age, injury, or disability, lack strength and/or dexterity required to grip a writing instrument, such as a pen or pencil, such that they have great difficulty in writing independently.

A writing assist device known as the Short Wanchik device is available and has a built-in grip that requires the user to lift his/her and in order to write. The device has been frustrating to use in that the user requires assistance to secure the device to the user's hand, in that the device can shift in position or fall off of the user's hand and may require additional attachment of a rubber band in order to stabilize the writing instrument, in that the device may be difficult to adjust to different writing instruments, and in that the device may require assistance of another person to adjusted to different user demands.

SUMMARY OF THE INVENTION

The present invention provides a writing assist device that is easy to use without assistance and comfortably receives the user's hand or portion thereof in a natural writing position for writing by moving the device without the need for the user to lift the device.

In an illustrative embodiment of the present invention, the writing assist device comprises a body having an exterior surface preferably with a convex contour on which the user's hand or portion thereof is received during writing in a natural writing posture during writing and a base adapted to easily slide on a writing surface. The body preferably ergonomically receives and supports the palm and/or fingers of the user's hand on the convex exterior surface contour for writing. The body includes an inclined channel for receiving a writing instrument, such as a pen or pencil, and a securing element to releasably secure the writing instrument at an inclined angle in the channel. A friction-promoting element preferably is disposed in the channel across from the securing element and against which the writing instrument is secured so as to prevent slipping of the writing instrument during use. The channel is disposed on the body such that the thumb and index finger of the user lie on opposite sides of the channel during writing in manner that generally resembles the natural gripping of a pen or pencil between the thumb and index finger of an able-bodied person to impart a more natural feeling of writing control. The hand-receiving body optionally can include first and second inclined channels symmetrically disposed on the body in order to permit use of the device by right-handed or a left-handed user.

A removable, stretchable cover can be placed on the exterior surface of the hand-receiving body for the comfort of the user. The cover can include a strap to receive the index and middle fingers of a user to secure the writing device to the user in the event the user lifts the device from the writing surface. The cover also can include a second strap to receive the thumb of a user or the index and middle fingers of the opposite dominant hand of a different user to this same end. The cover can be releasably secured on the hand-receiving body by an elastic band, drawstring and the like received in a recess such as a peripheral undercut, groove or the like on the body disposed above the base so that the base remains exposed for sliding on a writing surface.

The writing assist device of the present invention is advantageous in that the user using predominantly his/her upper arm, shoulder, forearm, and/or wrist simply moves the device by pushing or pulling around on the writing surface without any need to lift the device. The writing device can accommodate writing instruments of different size and/or shape in the channel(s) and can be used without assistance of others.

These and other features and advantages of the present invention will be set forth in the following detailed description taken with the following drawings.

DESCRIPTION OF THE INVENTION

In one embodiment, the present invention provides a writing assist device that is easy to use and comfortably receives the user's hand or portion thereof from underneath in a natural writing position for writing simply by moving the device on a writing surface using a pushing and/or pulling action of the user's upper arm, shoulder, forearm, and/or wrist. The user can adapt to his/her particular different level of muscle control and/or different part of his/her arm/shoulder to propel the writing assist device in a motion to write with the device.

Referring to FIGS. 1-5, an illustrative embodiment of a writing assist device 10 pursuant to the present invention is shown comprising a body 12 having an exterior surface 12*a* preferably with a convex contour for ergonomically receiving and supporting the palm and/or fingers of the hand of a user in a natural writing posture during writing. The hand-receiving body 12 preferably includes a flat, smooth base 12*b* adapted to easily slide on a writing surface such as a sheet of paper or a writing table surface without need for one or more wheels, rollers, balls, and the like thereon, although these may optionally be included on the base in practice of the invention to facilitate moving of the body. The body 12 can be made of light-weight plastic or any other suitable material as a one piece body or multiple pieces joined together. If injection molded, the body 12 may have a parting line L from the molding operation.

Figure 1:
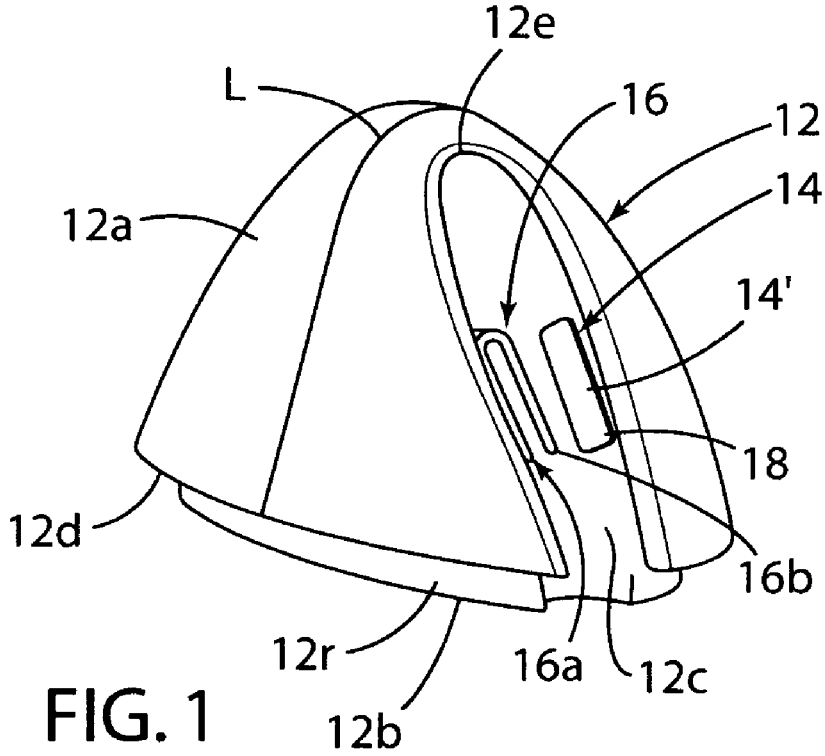
FIG. 1 is perspective view of a hand-receiving body of the writing assist device pursuant to an illustrative embodiment of the invention.
Figure 2:
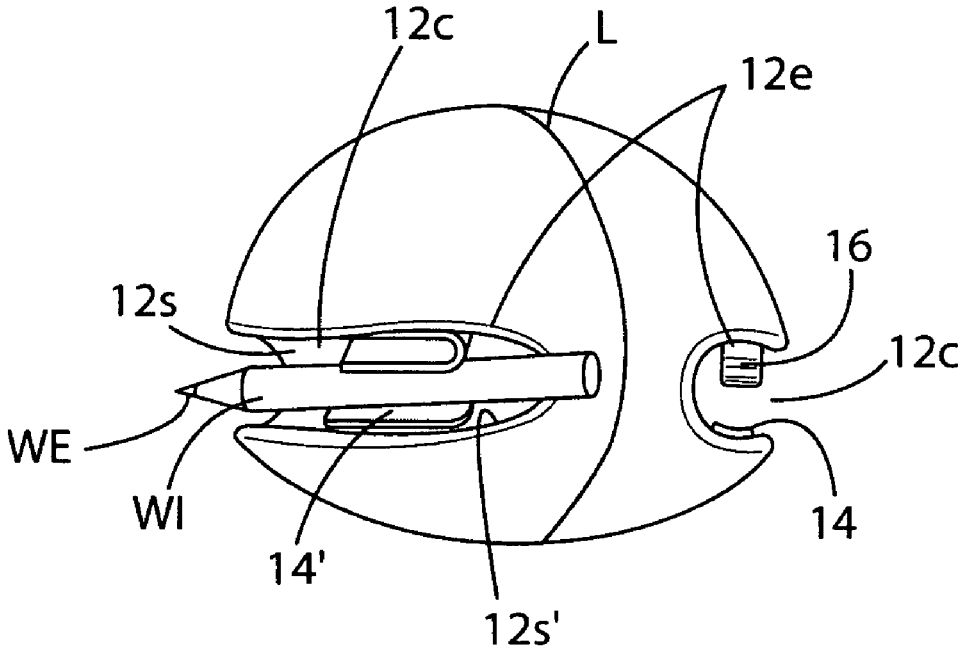
FIG. 2 is a plan view of the hand-receiving body of FIG. 1.

The hand-receiving body 12 includes one or more inclined, elongated channels 12*c* for receiving a writing instrument, such as a pen or pencil. For purposes of illustration and not limitation, FIGS. 1 and 2 illustrate the hand supporting body 12 as including first and second inclined channels 12*c* disposed symmetrically on opposite side regions of the body 12 in order to permit use of the device by right-handed or a left-handed user. Each channel 12*c* has a partial cylindrical concave contour to receive a writing instrument WI such as conventional pen or pencil, FIG. 6, although the shape of the channels 12 can be any suitable shape to this end. Each channel 12*c* is inclined at an angle of about 40 to about 70 degrees relative to the base 12*b* in order to orient the instrument writing in a customary orientation. Each channel 12*c* is disposed on the body 12 such that the thumb and index finger of the user's right hand or left hand, as the case may be, lie on opposite sides of the respective channel 12*c* during writing, FIG. 5, in manner that generally resembles the natural gripping of a pen or pencil between the thumb and index finger of an able-bodied person to impart a more natural feeling of writing control. The invention is not limited to first and second channels 12*c* and can be practiced with only one channel 12*c* on the body 12. The channel(s) 12*c* can be formed on the body 12 by molding (e.g. during an injection molding operation of the body), machining, or any other suitable method.

Each channel 12*c* has disposed therein a securing element 14 to releasably secure the writing instrument WI in each channel at an inclined angle so that the working end WE of the writing instrument will contact a writing surface, such as a sheet of paper when the writing assist device is slid thereon. For purposes of illustration and not limitation, FIGS. 1-5 show a generally U-shaped rubber-coated spring 16 having one end 16*a* affixed to a side 12*s* of each channel 12*c* and free end 16*b* that is positioned in the respective channel to bias the writing instrument in that channel toward the opposite side 12*s*' of that respective channel to releasably secure it in position in the channel. The end 16*a* of each spring can be affixed to the side 12*s* by adhesive, such as epoxy, mechanical fastener such as a screw, or any other appropriate fastening technique including a snap-fit connection or a slot-fit connection where end 16*a* is snap-fit or adhered in a slot (not shown) provided in the channel side 12*s*. The securing element is not limited to the U-shaped spring shown as other securing or clamping elements can be used. For example, a roller catch (not shown) like that of a cabinet door can be fastened in each channel 12*c* to this end.

Figure 3:
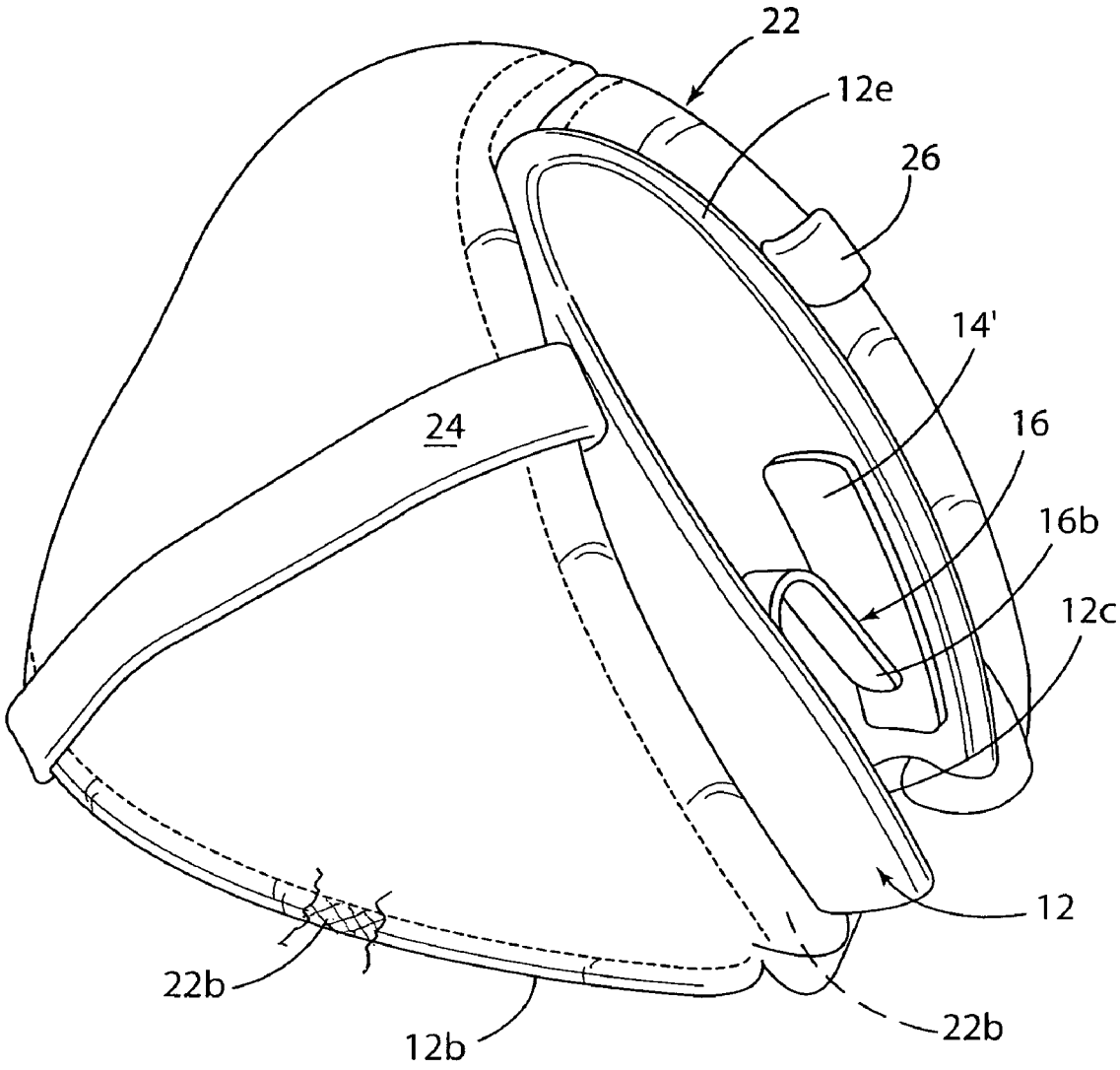
FIGS. 3 and 4 are perspective views of the writing assist device pursuant to an illustrative embodiment of the invention taken from different sides thereof and having the removable cover disposed on the hand-receiving body taken from opposite sides of the device

A friction-promoting element 18 preferably is disposed across from each securing element 14 in each channel 12*c*. For purposes of illustration and not limitation, FIGS. 1-3 show a friction-promoting rubber strip 14' having a length of about 1.5 inches affixed to the opposite side 12*s*' of each channel 12*c* from the free spring end 16*b* such that the writing instrument is biased by free spring end 16*b* toward and against the friction-promoting rubber strip to releasably secure the writing instrument in position against slippage in the channel during writing. The friction-promoting rubber strip 14' can be fastened directly to the side 12*s*' by adhesive or received and fastened in a slot (not shown) in the side 12*s*' so that half of the rubber strip thickness is received in the slot and the other half is exposed in the channel 12*c* opposing the free spring end 16*b*.

The hand-receiving body 12 includes an undercut recess 12*r* above and proximate the base 12*b* around the periphery of the body. The undercut recess forms a downwardly facing shoulder 12*d* on the body 12 that is used to secure an optional removable, stretchable cover 22 on the body 12.

Figure 4:
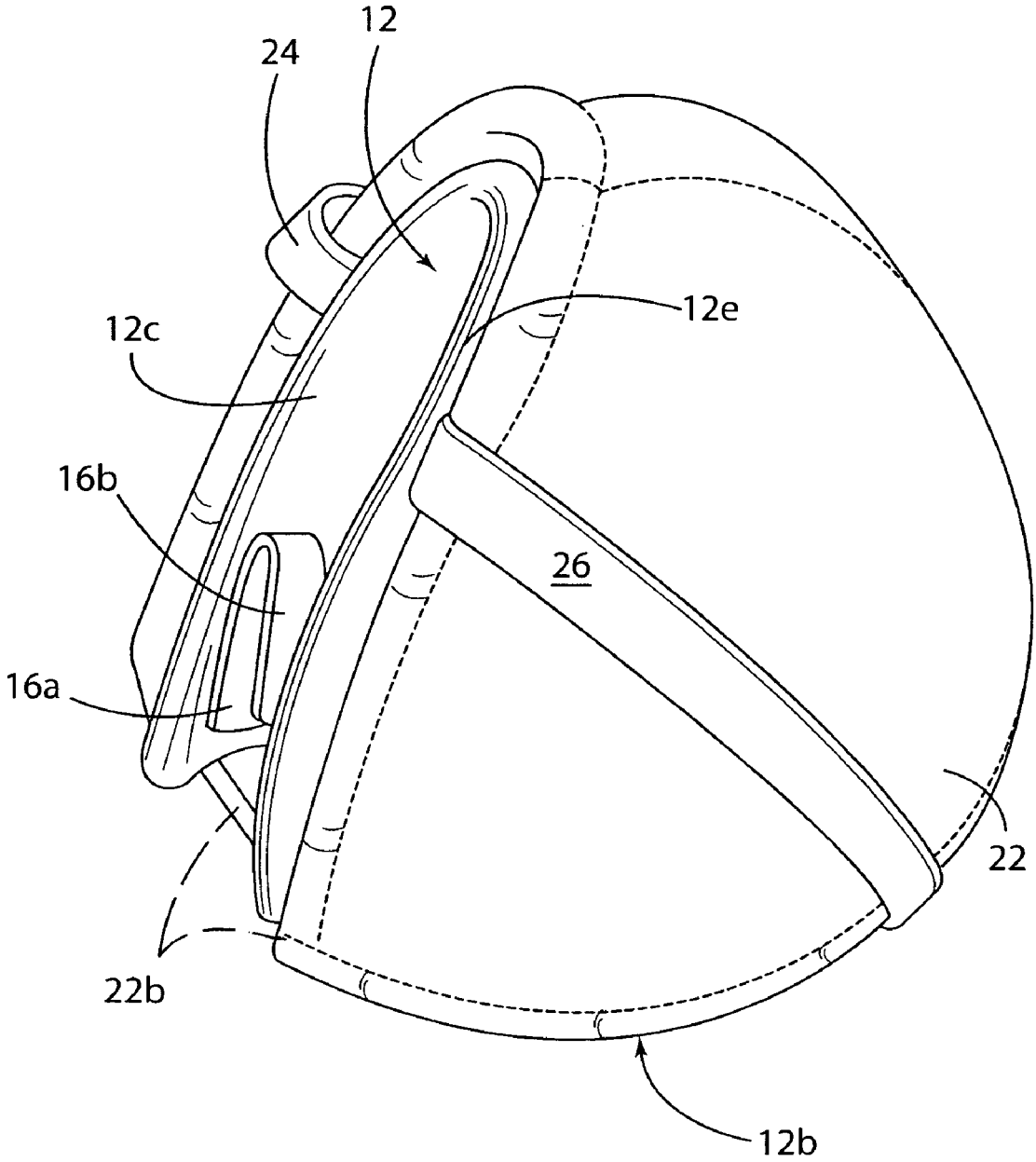

The removable, stretchable cover 22 optionally can be placed on the exterior surface of the hand-receiving body 12 for the comfort of the user. The cover 22 can be made of fabric that is stretchable such as spandex, lycra cotton blend or any suitable material. For purposes of illustration and not limitation, the cover is releasably secured on the body 12 by a sewn-in elastic band 22*b* of the cover being received in the undercut recess 12*r* against the shoulder 12*d* of the body above the base 12*b* so that the base remains exposed for sliding on a writing surface. In lieu of the undercut recess, a recessed groove, raised bead or other feature can be provided on the body against which the elastic band is received. For example, the elastic band is also received partially against a slightly raised bead 12*e* provided around the channel 12*c* that is in use by the user as shown in FIGS. 3-4, while the cover 22 covers the other channel 12*c* which is not in use. The elastic band 22*b* is sewn by stitching shown as dashed lines in the cover about its periphery to this end. A draw-string, snaps, or other attachment element can be used in lieu of the elastic band 22*b* on the cover to secure it to the body 12.

The cover 22 can include a first elastic strap 24 to receive the index and middle fingers of a user to help secure the writing device to the user's hand. The ends of the strap 24 are sewn into the cover as shown best in FIGS. 3-4. The cover can include a second elastic strap 26 to receive the thumb of the same user to this same end, or the index and middle fingers of the opposite dominant hand of a different user. The straps 24, 26 secure the writing assist device to the user's hand in the event the user lifts the device from the writing surface.

In lieu of the removable cover 22, the invention envisions providing a layer of soft tactile plastic, rubber, or other suitable material on or as part of the hand supporting body 12 to provide a desirable comfortable tactile feel to the user's hand. The soft layer can be laminated onto the body 12, sprayed on the body, or formed in any other suitable manner on or as part of the body.

Figure 5:
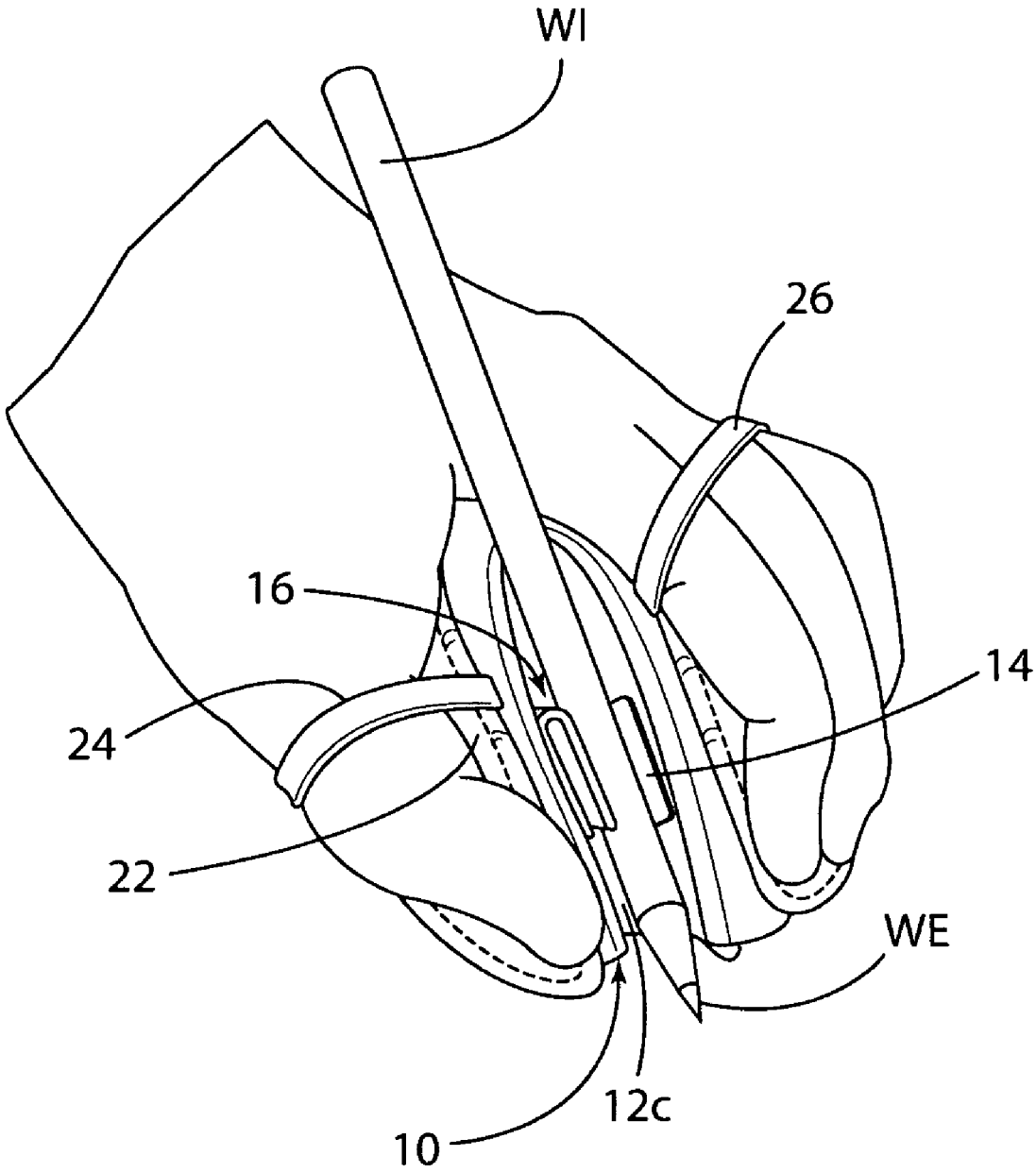
FIG. 5 is a perspective view of the writing assist device pursuant to an illustrative embodiment of the invention showing a user's hand thereon during use.

FIG. 5 illustrates a user's hand placed on the cover 22 on the body 12 with the thumb and index finger of the user's hand lying on opposite sides of the channel 12*c* during writing with the flat base 12*b* being easily movable (e.g. slideable) on a writing surface by the user's pushing or pulling the device predominantly using his/her upper arm, shoulder, forearm, and/or wrist so that the writing instrument secured in the inclined channel 12*c* writes on the writing surface (e.g. sheet of paper).

The writing assist device of the present invention is advantageous in that the user using his/her upper arm, shoulder, forearm, and/or wrist simply moves or slides the device by pushing or pulling around on the writing surface without any need to lift the device. The user can adapt to his/her particular different level of muscle control and/or different part of his/her arm/shoulder to propel the writing assist device in a motion to write with the device. The writing device can accommodate writing instruments of different size and/or shape in the channel(s) and can be used without assistance of others.

While certain embodiments of the invention have been described in detail above, those skilled in the art will appreciate that changes and modifications can be made therein within the scope of the invention as set forth in the appended claims.

What is claimed is:

1. A writing assist device, comprising a body having an exterior surface for receiving a user's hand during writing and a base adapted to be moved on a writing surface, said exterior surface having a convex contour that supports the user's hand or portion thereof from underneath during writing, said body having an inclined open-sided channel that is open along its entire length through said exterior surface for receiving a writing instrument so that the user can see the entire length of the writing instrument in the channel and on opposite sides of which channel a user's thumb and index finger are located during writing for gripping by the user to generally resemble natural gripping of a writing instrument during writing, and a securing element affixed in the channel to secure the writing instrument in the channel.

2. The device of claim 1 further comprising a friction-promoting strip disposed on a channel surface in opposing relation to the securing element and against which the writing instrument is secured by the securing element so as to prevent slipping of the writing instrument during use.

3. The device of claim 1 wherein the channel is inclined at an angle of about 40 to 70 degrees relative to the base.

4. The device of claim 1 further comprising a removable cover disposed on the exterior surface of the body for grasping by the user's hand.

5. The device of claim 1 wherein the body comprises one-piece lightweight plastic.

6. A writing assist device, comprising a body having an exterior surface for receiving a user's hand during writing and a base adapted to be moved on a writing surface, said body having first and second inclined channels symmetrically disposed on the body for receiving a writing instrument so as to permit use by a right-handed or left-handed user and a securing element to secure the writing instrument at an inclined angle in the first and second inclined channels.

7. A writing assist device, comprising a body having an exterior surface for receiving a user's hand during writing and a base adapted to be moved on a writing surface, said body having an inclined channel that opens through said exterior surface for receiving a writing instrument and on opposite sides of which inclined channel a user's thumb and index finger are located during writing, a securing element to secure the writing instrument at an inclined angle in the channel, and a removable cover disposed on the exterior surface of the body for grasping by the user's hand.

8. The device of claim 7 wherein the cover includes a strap to receive the index and middle fingers of a user to secure the writing device to the user in the event the user lifts the device from the writing surface.

9. The device of claim 8 wherein the cover includes a second strap.

10. The device of claim 7 wherein the cover is releasably secured on the body by an attachment element received in an attachment-receiving recess or bead surface of the body.

11. The device of claim 10 wherein the attachment element comprises an elastic band received in an undercut recess on the body disposed above the base so that the base remains exposed for sliding on a writing surface.

12. A writing assist device, comprising a body having an exterior surface for receiving a user's hand during writing, said exterior surface having a convex contour that supports the user's hand or portion thereof from underneath during writing, said body having an open-sided channel that is open along its entire length through said exterior surface for receiving a writing instrument so that the user can see the entire length of the writing instrument in the channel and on opposite sides of which channel a user's thumb and index finger are located during writing for gripping by the user to generally resemble natural gripping of a writing instrument during writing, and a securing element affixed in the channel to secure the writing instrument in the channel against an opposing friction-promoting surface in the channel so as to prevent slipping of the writing instrument in the channel during use.

* * * * *